United States Patent [19]

Batstone

[11] 4,236,258

[45] Dec. 2, 1980

[54] AUTOMATIC SWIMMING POOL COVER

[75] Inventor: Roger J. Batstone, Germantown, Md.

[73] Assignee: French Masterpieces, Incorporated, Germantown, Md.

[21] Appl. No.: 30,915

[22] Filed: Apr. 17, 1979

[51] Int. Cl.[3] ..... E04H 3/16; E04H 3/18

[52] U.S. Cl. ..... 4/501; 4/495; 220/85R

[58] Field of Search ..... 4/172, 172.12, 172.13, 4/172.14; 220/85

[56] References Cited

U.S. PATENT DOCUMENTS

| | | | |
|---|---|---|---|
| 2,731,168 | 1/1956 | Watts | 220/85 B |
| 2,924,350 | 2/1960 | Greer | 220/85 B |
| 3,509,585 | 5/1970 | Solomon | 4/172.12 |
| 3,523,308 | 8/1970 | Bradley | 4/172.12 |
| 3,533,110 | 10/1970 | Gisondi | 4/172.12 |
| 3,600,721 | 8/1971 | Pusey | 4/172.12 |
| 3,667,070 | 6/1972 | Pitti et al. | 4/172.12 |
| 3,732,581 | 5/1973 | Pitti et al. | 4/172.12 |
| 3,780,385 | 12/1973 | Dunn | 4/172.12 |
| 3,810,262 | 5/1974 | Strand | 4/172.12 |
| 3,813,704 | 6/1974 | Troiano | 4/172.13 |

FOREIGN PATENT DOCUMENTS

| | | | |
|---|---|---|---|
| 941497 | 11/1963 | United Kingdom | 220/85 B |
| 1165964 | 10/1969 | United Kingdom | 220/85 B |
| 1187777 | 4/1970 | United Kingdom | 220/85 B |
| 1214294 | 12/1970 | United Kingdom | 220/85 B |
| 1266483 | 3/1972 | United Kingdom | 220/85 B |
| 1287959 | 9/1972 | United Kingdom | 220/85 B |
| 1305817 | 2/1973 | United Kingdom | 220/85 B |
| 1439571 | 6/1973 | United Kingdom | 220/85 B |
| 1475182 | 6/1977 | United Kingdom | 220/85 B |

*Primary Examiner*—Henry K. Artis

*Attorney, Agent, or Firm*—Oblon, Fisher, Spivak, McClelland & Maier

[57] ABSTRACT

An automatic cover for a liquid storage container and a method of control corresponding thereto including a cover disposed within the container, a membrane connected to a portion of the storage container and connected along a peripheral portion of the membrane to the cover, the membrane and the cover separating the storage container into a liquid storage compartment and a liquid balancing compartment, a pressurized mechanism connected to the peripheral portion of the membrane for controlling the shape and dimension of the cover and a member for feeding balancing liquid to and for withdrawing balancing liquid from the liquid balancing compartment in such a manner that hydrostatic pressure of the storage container is maintained within any predetermined range.

9 Claims, 20 Drawing Figures

AUTOMATIC SWIMMING POOL COVER

BACKGROUND OF THE INVENTION

Automatic pool covers, the subject of this invention, may be used in swimming pools of any mode of construction, but will probably find most application in vinyl lined pools and in upgrading existing pools.

Use of an automatic pool cover will provide considerable cost and aesthetic benefits in upgrading existing pools, since the automatic pool cover will provide a new vinyl surface as well as the designed cover feature. Thus, existing pools can be upgraded without even emptying the pool. In many cases, emptying a weakened in-ground pool will cause complete failure due to the external hydrostatic pressure. Use of the automatic pool cover in such a pool may extend its useful life considerably.

The automatic pool cover consists of two sections (FIG. 1B);

(a) the pool cover section with shape and dimensions defined by the surface configuration of the pool, and (b) a membrane section with a shape defined by the interior surface of the pool and the shape of the pool cover.

The cover and membrane sections serve also to separate two compartments in the pool, namely the upper stored liquid compartment and a lower balancing liquid compartment. Water can be transferred by means of the external circulating pump from the balancing to the stored liquid compartment and vice versa. In the operating position all of the water is on the upper storage compartment, while in the covered position all of the water is in the balancing compartment. Thus, the pool can be maintained full at all times.

SUMMARY OF THE INVENTION

An object of this invention is to provide an automatic pool cover for considerably extending the useful life thereof.

A further object of this invention is to provide an automatic pool cover for maintaining hydrostatic pressure of the pool within a predetermined range, as well as controlling the shape and dimension of the cover of the pool.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein like reference characters designate like or corresponding parts throughout the several views, and wherein:

FIG. 1A discloses a top plan view of the automatic pool cover of the present invention, while

FIG. 2A discloses a cross-sectional view of the pressurized tensioning compartment of the present invention while

FIG. 6A discloses a plan view of an alternate embodiment of the pressurized tensioning compartment of the present invention while

FIGS. 7A–7D set forth various bottom styles of pools, while

DETAILED DESCRIPTION OF THE PREFERRED EMBODIMENTS

In order to provide the desired operating characteristics and for aesthetic reasons, an essential feature of the membrane separating the two compartments 1, 2 is a well defined and structurally stable, but flexible pool cover element 3. Thus structural stability is provided by a pressurized tensioning compartment(s) 4 around the periphery of the cover section. Pressurization is provided by filling these compartments with water and adjusting to the desired pressure via filling connection members 4A.

Figure 2A:
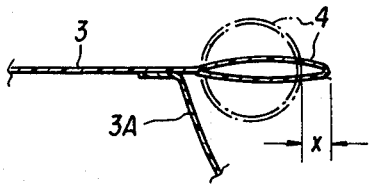

From FIG. 2A it is noted that the pressurization results in an adjustment in the dimension of the cover at one end by as much as distance "X", as the compartment 4 takes on a circular shape.

Figure 1A:
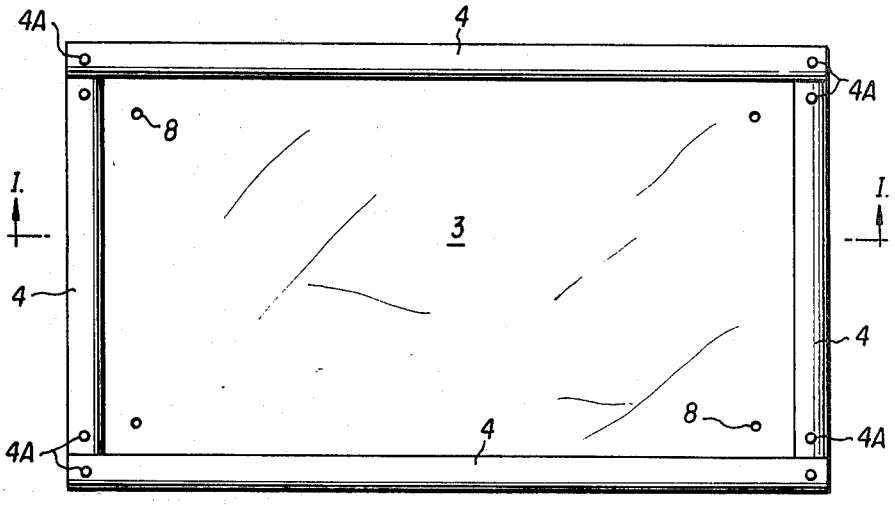

A continuously connected outer compartment 4 may be provided, or more usually separate compartments may be constructed at the two ends and two sides as shown in FIG. 1A. Four compartments 4 are indicated in this figure. More compartments may be provided as necessary, for example, to achieve greater flexibility at changes in sections in the base of the pool.

Figure 2B:
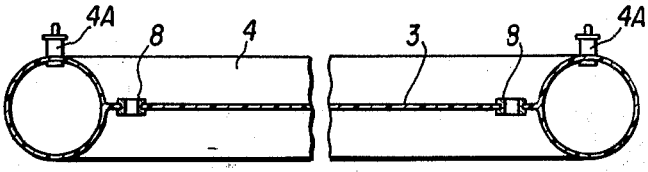
FIG. 2B is a cross-sectional view of a pressurized compartment with corresponding air valves and vents.

Pressurizing all compartments 4 to achieve the desired shape and dimensions for the pool cover section serves to pull the top pool cover 3 taut as it floats on the surface of water in the balancing compartment 1 (FIGS. 2A and 2B). A similar analogy is provided by pressuring a car tube with air which forces the tube to assume the desired circular configuration and provides a greatly increased structural stability as a result. In the same way, pressurizing the tensioning compartments 4 of the pool cover 3 causes the cover to take the shape defined in manufacture to correspond with the surface shape of the pool 6. With separate compartments 4 the tensioning and dimensions can be adjusted to allow for the usual variability in construction.

The tensioning compartments 4 may be required to withstand pressures of at least 1.5 to 2 times (or even higher) normal tap water pressure as it is expected that normally tap water will be used to pressurize the compartments. Lower pressure limits may also be appropriate as greater experience is gained in the operation of the system. Alternatively, the compartments 4 can be filled with water and pressurized with air. This allows a more ready adjustment of the operating pressure through the use of conventional air valves in the water filling connection. As air is compressible it is much less likely that the safe working pressure of the compartments 4 will be exceeded. These adjustments are made only after a pool liner 7 and automatic pool cover 3 have been installed and the balancing compartment 4 of the pool has been filled with water.

The most suitable dimension for the pressure tensioning compartments 4 will depend on the size of the pool 6, the material of construction and thickness of the pool cover and other factors. However, circular diameters in the range of 3" to 24" may be appropriate for most applications.

Air vents 8 are located in the four corners of the cover section (or in other locations as found appropriate in practice) to enable trapped air to be released during installation and operation. These vents 8 consist of conventional removable plugs with seals.

Figure 4:
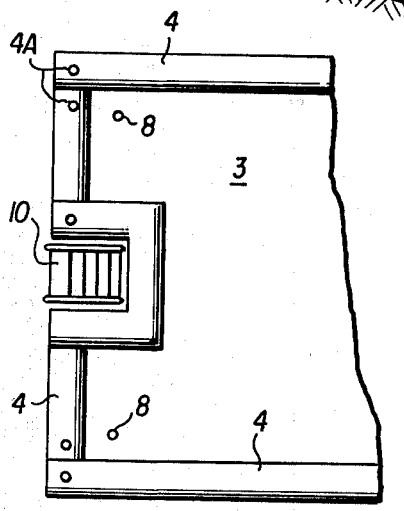
FIG. 4 sets forth an alternative embodiment of the pool cover of the present invention.
Figure 6A:
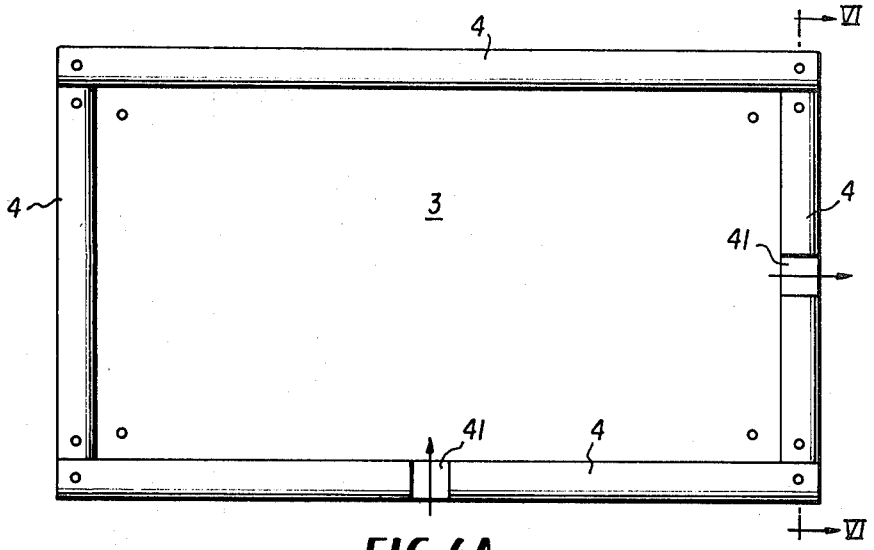
Figure 6B:
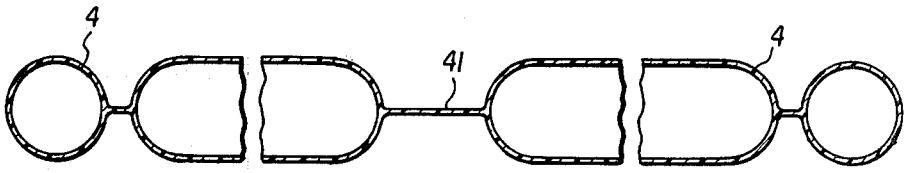
FIG. 6B is a view taken along line VI—VI of FIG. 6A.

Provisions can also be made in constructing pool cover sections for inserts 10 (as shown in FIG. 4) to clear pool ladders, etc. FIGS. 6A and 6B show a means whereby the drainage of water from above the cover can be facilitated by welding the tensioning compartment 4 together over a short section 4' opposite the overflow return line to the pump described hereinbelow and shown in FIG. 9. Likewise, flooding the cover 3 can be assisted by a similar arrangement at the inflow line from the pump.

Figure 1B:
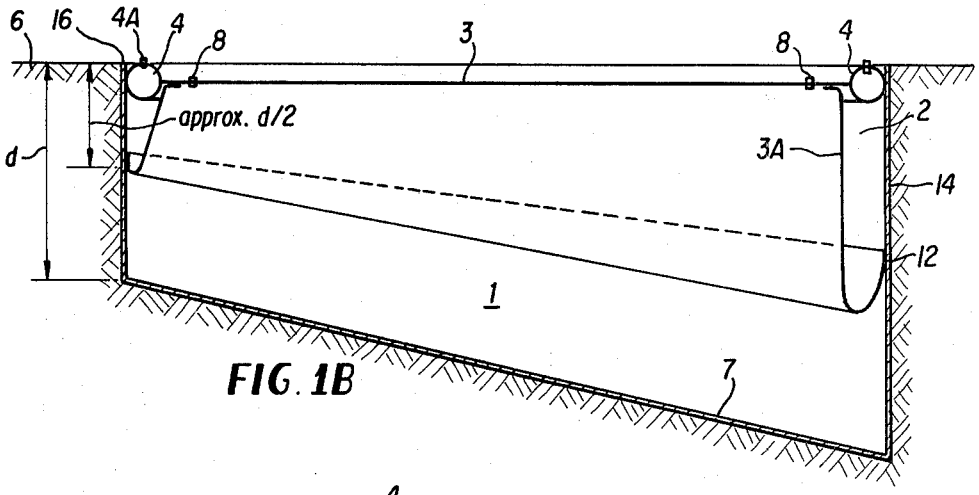
FIG. 1B is a view of the pool and pool cover of FIG. 1A taken along line I—I.
Figure 3A:
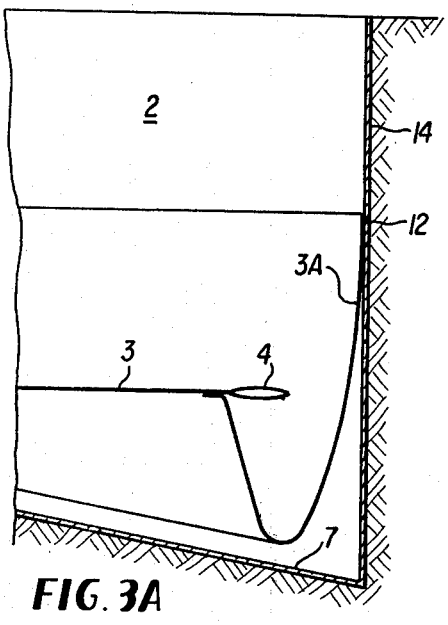
FIGS. 3A and 3B illustrate the operation of the automatic pool cover of the present invention.
Figure 3B:
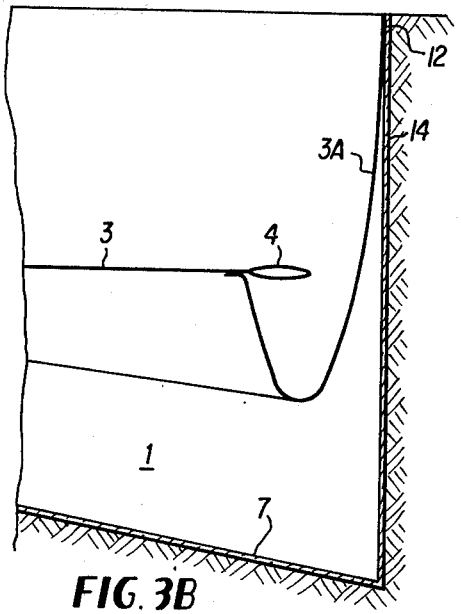

As shown in FIGS. 1A and 1B, a membrane section 3A is attached to the pool cover 3 around the inside periphery of the tensioning compartment 4 and is also joined to the pool liner 7 to form a seal or joint 12 between the balancing and storage compartments 1, 2, respectively, of the pool. In one possible configuration the seal may be located at approximately half the height of the pool wall 14, or alternatively, may be attached at the upper edge of the pool by means of conventional methods used to attached pool liners (as shown in FIGS. 3A and 3B).

Where the membrane 3A is attached to the vinyl liner 7 (as shown in FIGS. 1A and 1B), the seal or joint 12 may be formed either in the workshop where the liner and pool cover are manufactured or, alternatively, at the construction site. The former method provides a better means of quality control, but the best method will depend on the particular circumstances of a given case. This means of attachment reduces the quantity of liner material required in any instance, but may be limited in application to new liner constructed pools since it may not be possible to reduce the water level in an existing liner pool sufficiently for hydrostatic head reasons. The seal or joint 12 is most effectively made in vinyl liner 7 by means of electronic or heat welding which requires a readily accessible clean dry surface.

Other advantages of locating the membrane seal or joint 12 in the vertical wall 14 section include:

(a) better control of the hanging membrane material, and (b) allows for a light, ladder, and other wall fittings to be installed directly into the pool liner above the joint.

With the membrane attachment as shown in FIG. 3A and FIG. 1B, the hanging membrane material is kept away from the vertical wall 14 by the tensioning compartment 4 in the pool cover 3. The amount of hanging material is reduced and the position of attachment to the wall prevents loose material from building up against the wall as the cover rises.

The method of attachment shown in FIGS. 3A and 3B provides greater versatility, since it is not necessary to weld the membrane 3A to the liner material 7 (although this is still an acceptable method of attachment). This automatic pool cover 3 can be installed in existing as well as new pools with little difficulty. Conventional methods can be used for securing the end of membrane 3A to the top edge 16 of the pool 6. The loose hanging membrane material is kept clear of the wall 14 by attaching the other end to the pool cover 3 on the underside and behind the tensioning compartment 4. The two sections are electronically welded together in this position in the factory at the time of manufacture forming the complete automatic pool cover.

Once installed, it is possible to convert to the attachment arrangement shown in FIG. 3A by electronically welding the membrane 3A at the construction site to the pool liner along a line at approximately half the depth of the vertical wall section. This method of installation may prove more convenient in some applications than an automatic cover which is joined on the vertical wall in the factory prior to installation. The membrane 3A and liner 7 may be welded at other sections, as for example, installation of pool ladders, lights and other fittings as appropriate.

Figure 5:
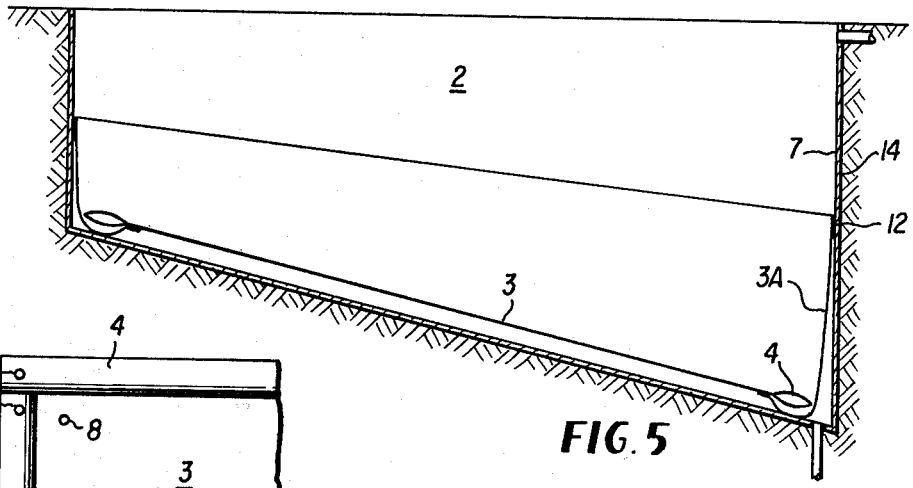
FIG. 5 discloses the location of the automatic pool cover during operation of the present invention.
Figure 7A:
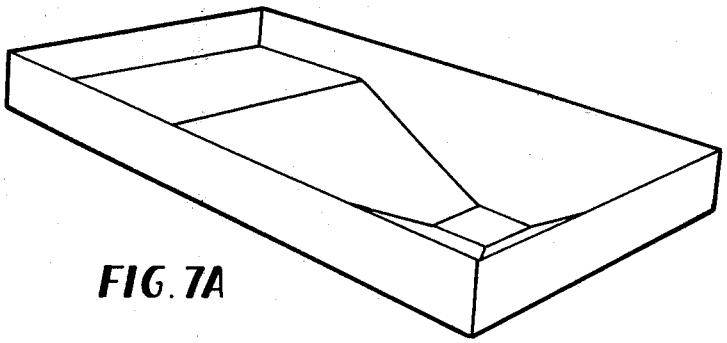
Figure 7B:
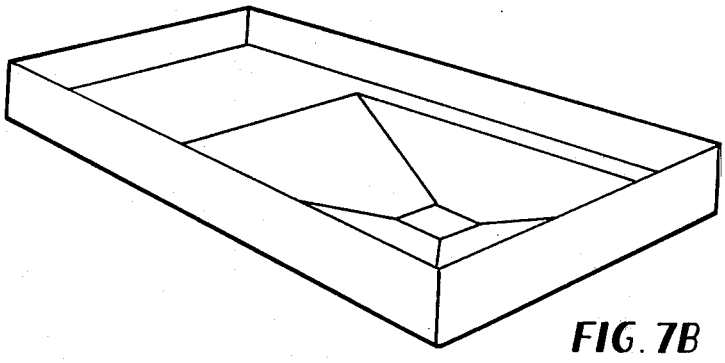
Figure 7C:
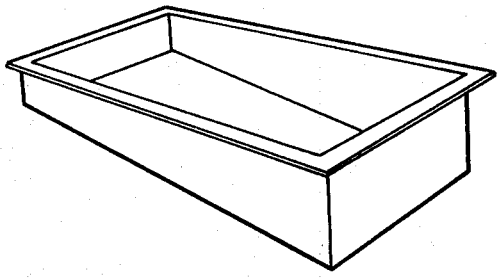
Figure 7D:
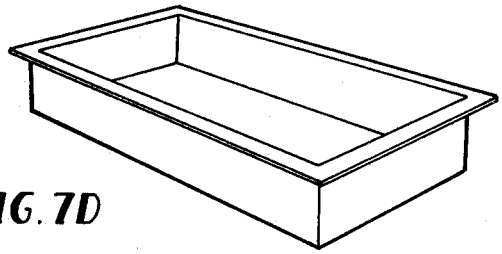
Figure 8A:
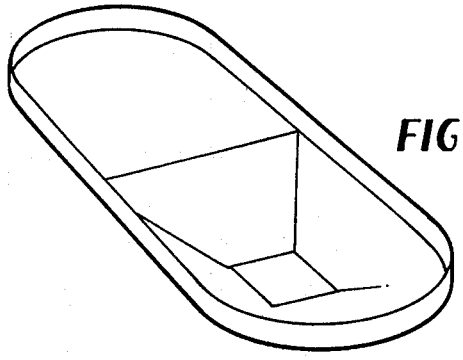
FIGS. 8A–8E shows various embodiments of pool shapes and bottoms.
Figure 8B:
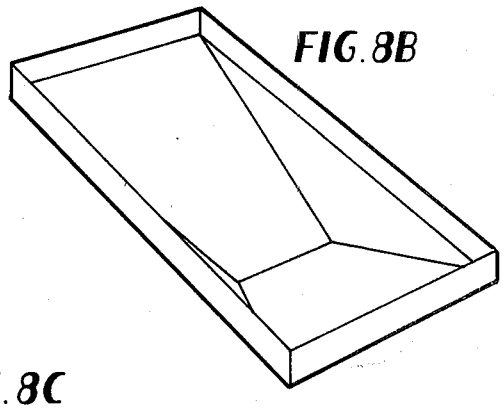
Figure 8C:
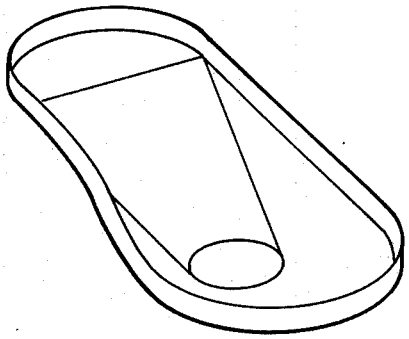
Figure 8D:
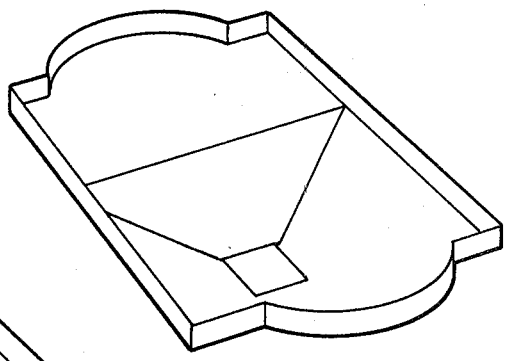
Figure 8E:
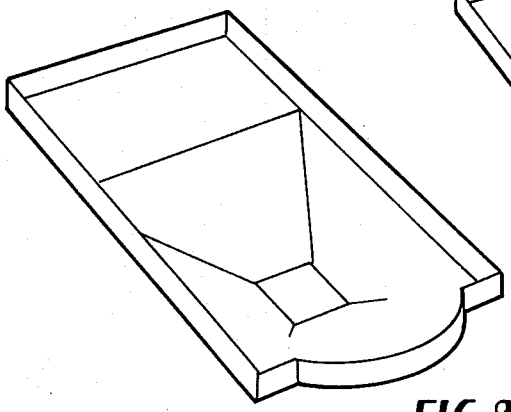

The membrane shape in all instances is determined by the internal and surface configurations of the particular pool applications. Since the cover section corresponds to the surface dimensions, the membrane 3A must be cut out to fit the internal dimensions of the pool 6 with the cover section located on the base of the pool as shown, for example, in FIG. 5. For the flat bottom and straight sloping rectangular pool (FIGS. 7D and 7C, respectively), the shape of the membrane is readily determined. Hopper pools and pools with non-rectangular surfaces (see FIGS. 7A and 7B, as well as FIGS. 8A–8E) present a more complex membrane shape configuration, but the same principle applies for determining the shape; namely, to fit the internal pool dimensions with the pool cover section 3 located flat on the base. When the automatic pool cover is installed and the pool is in operation ready for use, the pool cover 3 and membrane 3A will lie flat against the walls 14 and base of the pool without wrinkles. In the case of the hopper-style pools, some wrinkling of the cover section may appear in the deep water section at the hopper, but will not detract from the surface appearance of the pool, nor interface with the vacuum cleaning of the pool.

Polyvinyl chloride (vinyl) in thicknesses varying from 10 mills to 30 mills is almost exclusively used as the plastic lining material for lined swimming pools, above and below ground. This material is also a suitable material for construction of the automatic pool cover 3 which is the subject of this invention. Other materials of construction for the membrane material such as unreinforced and reinforced polymers, for example, polyethylene, polypropylene, butyl rubber, chlorinated polypropylene, hypalon, and ethylene-propylene diene monomer and others.

The same methods of fabrication already used by manufacturers of vinyl liners and swimming pool covers are applicable to automatic swimming pool covers. Lap welded seams are recommended in preference to butt welded seams to provide additional strength. Colored vinyl fabrics may be used for both the cover and membrane sections which will generally match the color of the vinyl liner used for pool construction. Translucent vinyl may also be used in the construction of the membrane section to facilitate inspection of the balancing compartment and to allow light transmission from a light fitting already installed in a vinyl liner or other form of pool construction. Translucent inspection and light fitting parts may also be welded into the membrane or pool cover for the same purpose.

Factory fabricated integral automatic pool covers and vinyl liners can be installed in a dry excavation using the same technique as for a conventional vinyl liner pool. A separate automatic pool cover can also be installed in a dry, previously lined excavation or dry pool to be reconditioned by use of the cover following a similar technique. Alternatively, the cover 3 can be installed in a full or partially filled pool.

In a dry excavation, the automatic cover 3 is unfolded with at least one person on each corner of the cover (or combined liner/cover). Each person moves to the appropriate corner of the pool and begins to push it into each corner to form a snug fit. When in place, the top of the membrane is temporarily held onto the attachment plate with weights. A vacuum cleaner is used to draw air out from under the cover and a broom is used to smooth out wrinkles in the cover so that it fits exactly in place.

The tensioning compartments 4 are then filled with water before filling the pool 6. When the pool is full, the membrane section 3A of the cover 3 can be secured in position permanently on an attachment plate which may then be covered with topping material such as wood, stones, pavings, etc. Water is then pumped from the upper storage section 2 to the balancing section 1 until the cover is exposed on the surface of the pool. In this position, the pressure in each tensioning compartment 4 is adjusted to give a snug fit with the wall 14.

When installing the automatic pool cover 3 in a full or partially full pool, the membrane section 3A is folded under the pool cover 3. The four corners are then carried to the corresponding corners of the pool and laid in position on the surface of the water. The ends of the membrane are temporarily held on the attachment plate with weights. Each tensioning compartment 4 is filled with water and the pressure adjusted to give a snug fit with the wall. As water is transferred from the balancing compartment to the upper storage compartment, the membrane is smoothed out against the wall using a broom.

In swimming pool applications, use of a flexible membrane to separate the balancing and stored liquid provides the possibility of utilizing the membrane as an automatic cover for safety and heat, water and chemical conservation purposes.

Design pumping rates for swimming pools normally aim to filter the entire content of the pool in 8–12 hrs. With the proposed design, a shorter turnover time is desirable, although during pumping of the contents from balancing compartment 1 to storage compartment 2, or vice versa, the main pool filter 20 shown in FIG. 9 may be bypassed. An inline self-cleaning cartridge filter or other type of coarse filter 22 may be provided to prevent transfer of sand and other coarse particles into the balancing compartment.

In this proposed design, higher pumping rates for transferring liquids between storage or balancing sections can be obtained by increasing line size, careful pump and coarse filter selection and bypassing the main filter 20 and heater 24 (if also provided). For this condition, a transfer time of approximately one hour would be desirable to secure the safety of the pool and to quickly make the pool ready for reuse.

Figure 9:
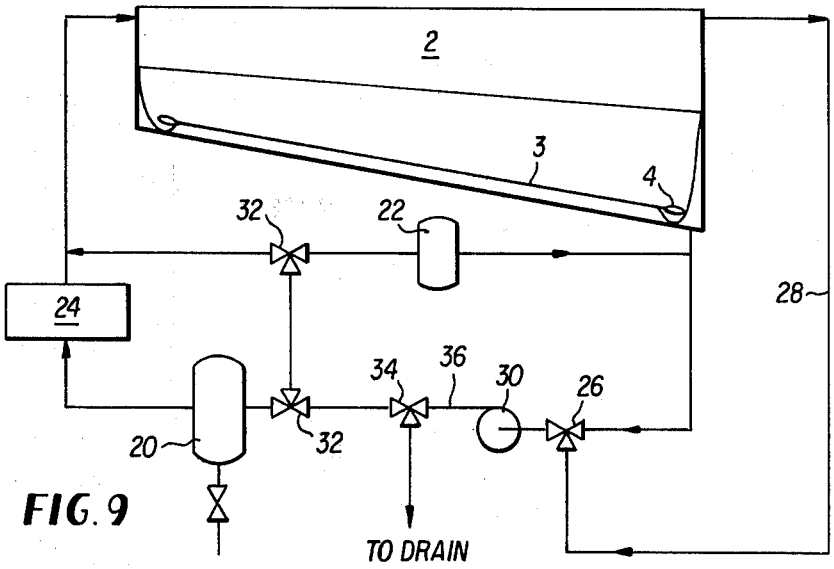
FIG. 9 shows the liquid transfer system for the automatic pool cover of the present invention.

A pressure switch 26 in the suction line 28 to the upper storage compartment may be used to automatically shut off the pump(s) 30 when all the liquid has been transferred to the balancing compartment 1. Automatic pressure or flow switching may be provided to terminate transfer from the balancing to the storage compartment in a coordinated manner. Block valves, 3-way and bypass valves 32 can be provided as shown in FIG. 9.

A drain valve 34 is provided in the pump discharge line 36. Because of hydrostatic pressure, single vinyl liner pools cannot generally be emptied. This objection is overcome with the proposed design, as the lower compartment can be emptied through the pump drain valve 34, while a separate clean water supply is provided to the upper compartment. The rates of the two flows can be balanced so that the upper compartment fills at the same rate as the lower compartment is emptied.

Likewise, with the upper membrane on the surface, a separate water supply can be used to wash the cover, while the pump section is connected to the overflow line and the drain valve is open.

The pool can be operated in a shallow mode for the convenience and safety of young children by transferring water from the balancing to the storage compartment or vice versa until the depth of water above the pool cover is suitable for this purpose (18"–24"). The pump can then be stopped or placed in recycle mode to maintain this depth until the pool required to be covered or returned to its normal function.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An automatic cover for a liquid storage container comprising:

a cover disposed within said storage container;

a membrane connected to an upper portion of said storage container and connected along the peripheral portion of said membrane to said cover, said membrane and said cover separating said storage container into a liquid storage compartment and a liquid balancing compartment;

pressurized means connected to said peripheral portion of said membrane for controlling the shape and dimension of said cover; and means for feeding balancing liquid to and for withdrawing balancing liquid from said liquid balancing compartment in such a manner that hydrostatic pressure on said storage container is maintained within a predetermined range wherein said pressurized means comprises at least one compartment member connected along a substantial portion of said peripheral portion of said membrane.

2. An automatic cover as set forth in claim 1, further comprising:

a liner connected to said membrane at said upper portion to form a seal between said liquid balancing compartment and said liquid storage compartment and to form a lower enclosure portion for said liquid balancing compartment, said liner being connected to said storage container.

3. An automatic cover as set forth in claim 1, such storage container further comprising:

a container opened at the top portion thereof.

4. An automatic cover, as set forth in claim 1, said pressurized means comprising:

a plurality of compartment members connected along the entire peripheral portion of said membrane.

5. An automatic cover, as set forth in claim 1, said pressurized means comprising:

a plurality of pressurized compartment members; and drainage means interconnecting said pressurized compartments for draining liquid located above said cover.

6. An automatic cover as set forth in claim 1, further comprising:

means for feeding storage liquid to and from said liquid storage compartment.

7. An automatic cover as set forth in claim 6, further comprising:

means for coordinating feeding of liquid to and discharge of liquid from said liquid balancing compartment and said liquid storage compartment, respectively.

8. An automatic cover, as set forth in claim 1, wherein said upper portion of said storage container comprises a wall portion thereof.

9. An automatic cover, as set forth in claim 1, wherein said upper portion of said storage container comprises an upper edge portion thereof.

* * * * *